United States Patent [19]

Kirkup et al.

[11] Patent Number: 4,651,911

[45] Date of Patent: Mar. 24, 1987

[54] ROLL MATERIAL DISPENSER CARTON

[75] Inventors: Thomas J. Kirkup, Henrico County; James D. Turek, Richmond, both of Va.

[73] Assignee: Reynolds Metals Company, Richmond, Va.

[21] Appl. No.: 837,898

[22] Filed: Mar. 10, 1986

[51] Int. Cl.[4] ..... B65D 85/672

[52] U.S. Cl. ..... 225/20; 225/47; 225/48; 225/53; 225/89

[58] Field of Search ..... 225/47–50, 225/19, 20, 53, 89

[56] References Cited

U.S. PATENT DOCUMENTS

| | | | |
|---|---|---|---|
| 2,533,841 | 12/1950 | Russell | 225/47 |
| 2,888,180 | 5/1959 | Kinker, Jr. | 225/39 |
| 3,477,624 | 11/1969 | Branyon et al. | 225/47 X |
| 3,547,328 | 12/1970 | Bjorklund | 225/49 |
| 3,552,614 | 1/1971 | Wilson et al. | 225/48 X |
| 3,565,307 | 2/1971 | Wiley et al. | 225/47 |
| 3,698,548 | 10/1972 | Stenzel et al. | 206/58 |
| 3,722,767 | 3/1973 | Struble | 225/49 |
| 4,119,251 | 10/1978 | Golner et al. | 225/47 X |
| 4,238,065 | 12/1980 | Ragsdale | 225/47 |
| 4,340,162 | 7/1982 | Heiman et al. | 225/48 |
| 4,346,830 | 8/1982 | Hauser | 225/49 |
| 4,399,935 | 8/1983 | Nelder | 225/49 |

*Primary Examiner*—Frank T. Yost

*Attorney, Agent, or Firm*—Alan T. McDonald

[57] ABSTRACT

A dispenser carton for roll products, such as plastics resin film or metallic foil, is disclosed. The carton includes an integral cutting blade which may be locked into position during operation of the carton and which may also be stored within the carton during transport or storage of the carton.

7 Claims, 5 Drawing Figures

ROLL MATERIAL DISPENSER CARTON

BACKGROUND OF THE INVENTION

Rolls of sheet materials, such as plastics resin films and metallic foils, especially aluminum foil, are routinely dispensed from cartons. There are generally two classes of such cartons. For home use, where the lengths of the sheet material are relatively small, the cartons are designed to be held in one hand while operated by the other hand. However, in commercial applications, such as foodservice operations, much larger rolls of these same sheet materials are dispensed. In this case, the carton rests on a counter and the sheet material is pulled from the carton, with the carton remaining in place on the counter and the sheet material is cut by a cutter edge located at the top front edge of the dispenser carton.

There are several problems inherent in such dispenser cartons. First, there is a problem in producing a dispenser carton which includes an integral cutter edge which is both safe and simple to erect and which stores easily during transport or storage of the carton.

Second, there are problems associated with support of the roll of sheet material within the dispensing carton. The roll cannot be permitted to rest on the floor of the carton, and must be supported about a core around which the sheet material is wound. The use of supports formed integrally with the carton adds to its complexity and are not always of sufficient strength to withstand rough handling of the carton.

It is thus a primary objective of the present invention to provide a dispensing carton for sheet materials, primarily plastics resin films, but also for such metallic sheet materials as aluminum foil, in which the cutter edge may be securely locked in place during use and safely stored during transport or storage of the carton while facilitating easy set-up of the carton.

It is also a primary objective of the present invention to provide a carton having a core support which can withstand relatively rough treatment of the carton without failure.

THE PRESENT INVENTION

By means of the present invention, these desired objectives are obtained. According to the present invention, a carton primarily for plastics resin film rolls, but usable for metallic foil rolls, such as aluminum foil rolls, is disclosed. The front panel of the carton includes an extension thereof having a cutter edge at one end thereof, with the extension being folded upon itself such that the cutter edge may be easily stored during transport or storage of the carton. Further, the extension of the front panel carrying the cutter edge includes slits or openings therein into which locking tabs forming a portion of the top panel may fit, assuring that the cutting edge remains locked in place during use of the carton.

The carton construction of the present invention also includes core support members separate from the carton blank which are constructed and arranged not only to support the sheet material within the carton but also to provide a resting position for the cutting edge during storage or transport of the carton.

BRIEF DESCRIPTION OF THE DRAWINGS

The dispenser carton of the present invention will be more fully described with reference to the drawings in which.

DETAILED DESCRIPTION OF THE PREFERRED EMBODIMENT

Figure 1:
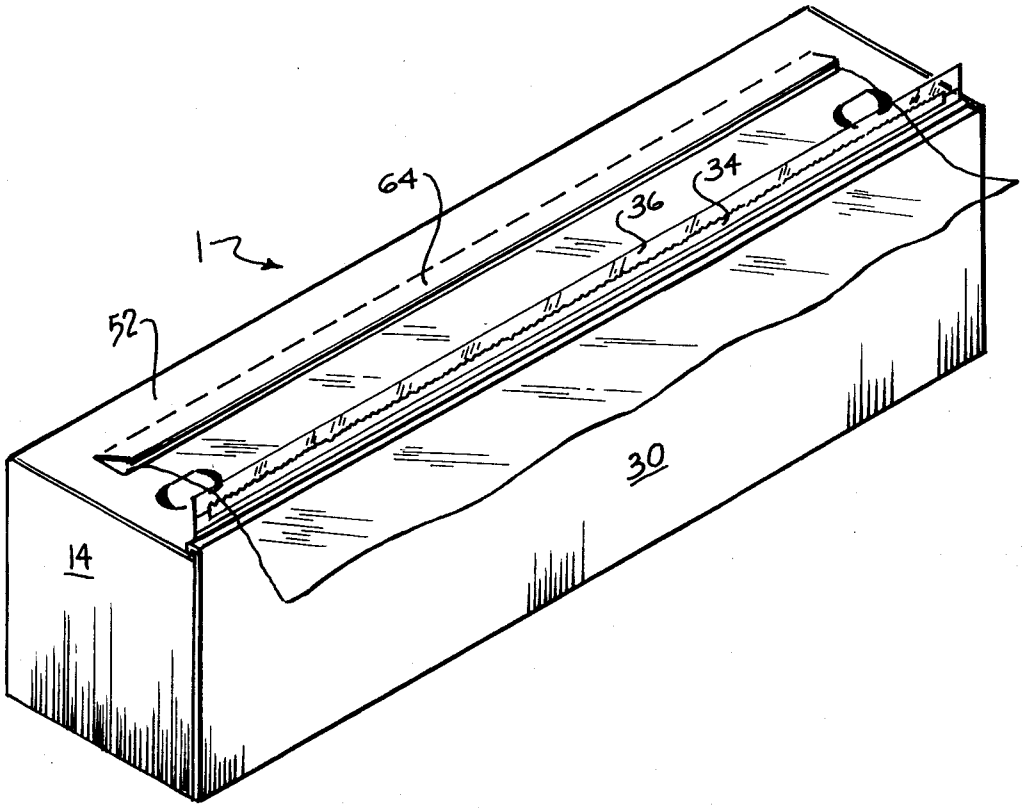
FIG. 1 a perspective view of the dispenser carton in its dispensing state.
Figure 2:
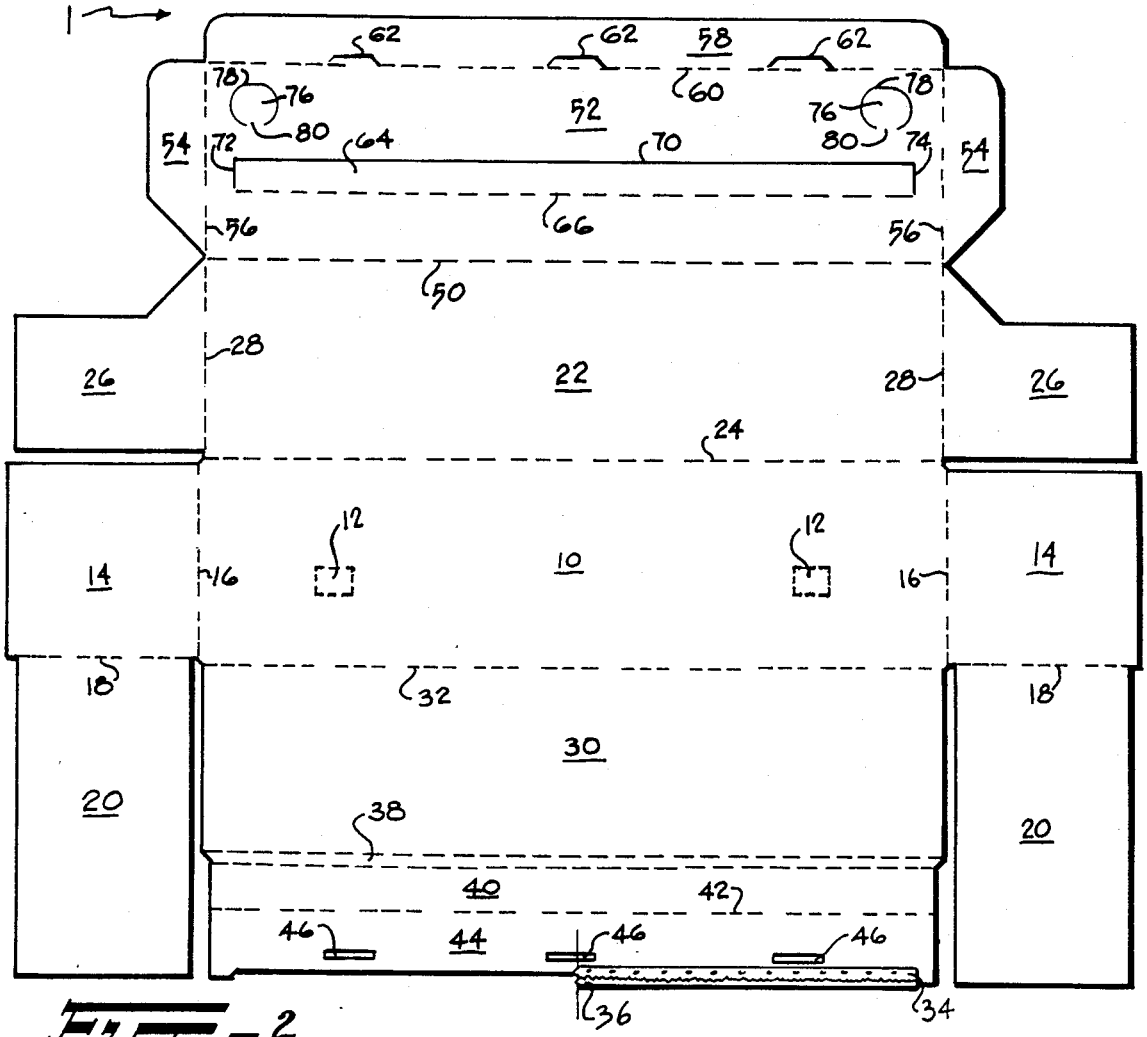
FIG. 2 is a top perspective view of the carton blank from which the dispenser carton of the present invention is formed.

Turning now to the FIGURES, and particularly FIGS. 1 and 2, the dispensing carton 1 of the present invention is illustrated. The carton 1 includes a bottom wall 10 to which may be attached a pair of rubber feet 12 for stability of the dispensing carton 1 when in use. At each end of bottom wall 10 is a side wall 14. Side walls 14 are attached to bottom wall 10 by scorelines or creases 16 in the material forming the carton blank 1, which is typically a corrugated cardboard or paperboard. The scorelines or creases 16, as other scorelines or creases to be mentioned below, permit relatively easy folding of the various walls during assembly of carton 1. Attached to side walls 14 by means of scorelines 18 are a pair of reinforcing walls 20. These walls 20 are positioned during forming after side walls 14 are raised into place. A back wall 22 is attached to bottom wall 10 by means of scoreline 24 and after being raised in position reinforcing walls 26 are positioned against that wall 22 by means of scorelines 28. Front wall 30, which is attached to bottom wall 10 by means of scoreline 32, is positioned in front of reinforcing walls 20. Front wall 30 carries along an extension thereof cutting blade 34, and preferably a cutting blade guard 36, depending upon the material being dispensed within carton 1. The choice of cutter blade 34 is also dependent upon the material being dispensed by carton 1 and its selection is well-known to those of ordinary skill in the art. Cutter blade 34 is connected to front wall 30 through crushed and scored region 38 and inner extension 40, scoreline 42 and outer extension 44. As can best be seen in FIG. 4, when the carton 1 is in its storage mode, inner and outer extensions 40 form a generally v-shaped region such that cutter blade 34 fits within carton 1. Outer extension 44 also includes one or more slits or openings 46 for locking cutter blade 34 in position during use, as will be explained below.

An additional advantage in placing the cutter blade 34 on front panel 30, rather than on top panel 52, is that, should the top panel 52 be damaged during opening of carton 1, carton 1 will still operate satisfactorily.

Attached to back wall 22 through perforated line 50, for ease of opening and closing, is top wall 52. Top wall 52 includes side flaps 54 attached thereto by means of scorelines 56 and front flap 58 attached thereto by means of scoreline 60. Also attached along line 60 by means of cut lines are one or more tabs 62. These tabs 62 cooperate with slots 46 in extension 44 when the carton is in its operating position to support and maintain the position of cutter blade 34, as will be described below. Top panel 52 also includes a material passage way 64 formed by perforated line 66 and cut lines 70, 72 and 74. Top panel 52 may also include a pair of finger openings 76 formed by cut lines 78 and scorelines 80 to permit the user to grab the material being dispensed more easily.

Figure 3:
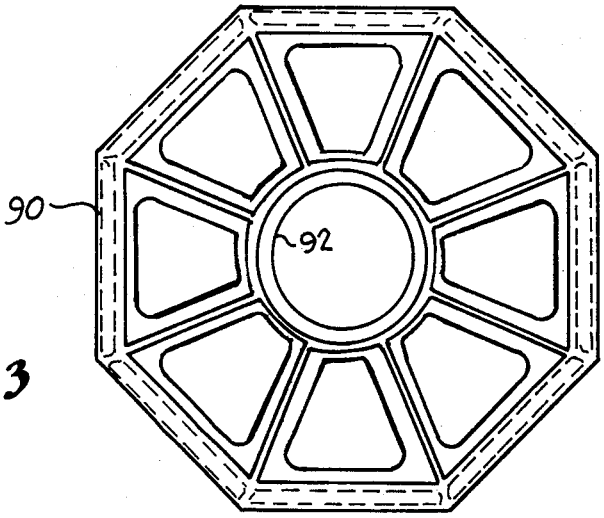
FIG. 3 is a side elevational view of the core support employed in the dispensing carton of the present invention.

As can be seen above, there is no integral means for supporting a roll of sheet material in the blank forming carton 1. The support means is illustrated in FIG. 3. The support means comprises a pair of shaped supporting elements 90 having an opening 92 in the center thereof into which a core 96 carrying sheet material 94 may be inserted. These support elements 90 are positioned on each end of the core 96.

Figure 4:
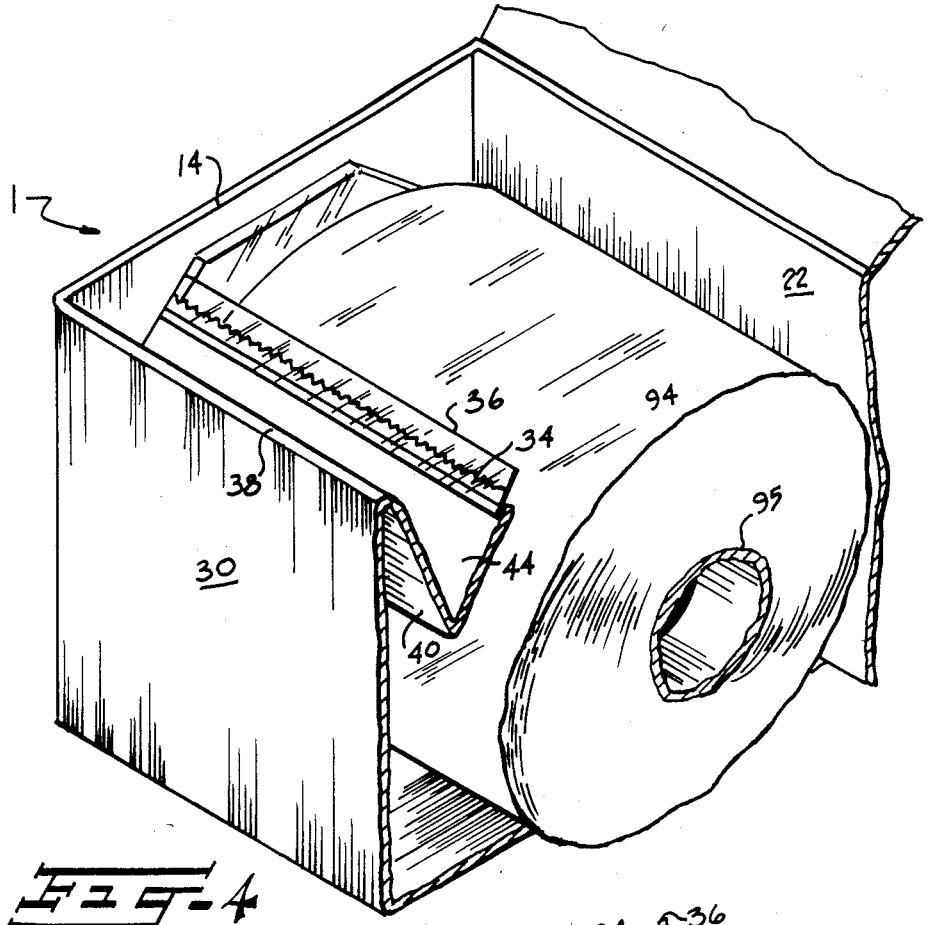
FIG. 4 is a partial perspective view, with the carton top removed, illustrating the positioning of the cutter edge during storage.

While the supporting elements 90 may take numerous shapes, such as round, square, hexagonal and the like, it is preferred that the supporting element 90 be in the form of a hexagon. This provides a flat surface against bottom wall 10, front wall 30, back wall 22 and top wall 52 and provides a resting surface against which the outer extension 44 carrying cutter blade 34 may rest when the carton 1 is in its storage condition, as shown in FIG. 4.

The supporting elements 90 may be formed of numerous materials, but are preferably formed of plastics resins, such as polyethlyene, polypropylene and the like.

Figure 5:
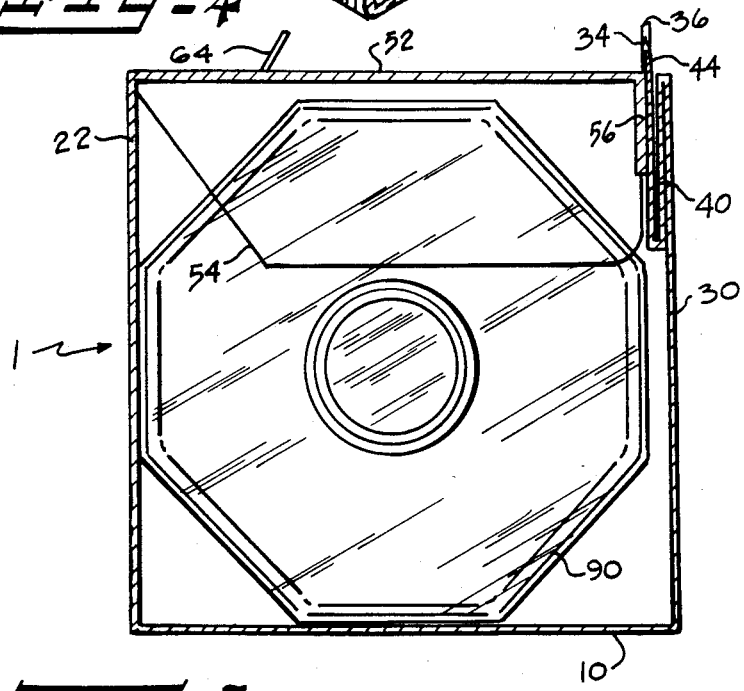
FIG. 5 is a side sectional view, with the end panel removed, illustrating the positioning of the cutter edge in its dispensing mode.

FIG. 5 illustrates a side view of the dispenser carton 1 with side panel 14 removed. In this FIGURE, cutter blade 34 is firmly held in place by tabs 62 and front panel 58 and slots 46 and outer extension 44 and by the spring action of panels 56, 44, 40 and 30 against one another. To position cutter blade 34 in place for use, a user simply opens top panel 52, pulls extensions 40 and 44 against front panel 30 and closes top panel 52, while inserting tabs 62 into slots 46. To return the carton to its storage position requires only reversal of these steps.

From the foregoing, it is clear that the present invention provides a dispensing carton for sheet material products which has overcome the drawbacks of those cartons currently used for commercial dispensing of such materials.

While the invention has been described with reference to certain specific embodiments thereof, it is not intended to be so limited thereby, except as set forth in the accompanying claims.

We claim:

1. In a dispenser carton for rolls of sheet material comprising front, side, rear, top and bottom panels the improvement wherein said front panel includes inner and outer extensions thereof and a cutter blade attached at the outer edge of the outer extension thereof, said extensions being foldable to store said cutter blade within said carton during storage of said carton and to expose said cutter blade during use of said carton, and a pair of support elements unattached to said carton for supporting said sheet material within said carton, said outer extension including openings therein and said top panel including tabs therein to lock said cutter blade in place during use.

2. The carton of claim 1 wherein said support elements are generally octagonal and support said cutter blade during storage of said carton.

3. The carton of claim 2 wherein said support elements are formed from a plastics resin.

4. The carton of claim 1 wherein said cutter blade includes a guard.

5. The carton of claim 1 wherein said bottom panel includes stabalizing feet thereon.

6. The carton of claim 1 wherein said top panel includes a slot through which said sheet material passes.

7. The carton of claim 6 wherein said top panel includes finger guide openings therein.

* * * * *